United States Patent [19]

Mogaki

[11] 4,186,733

[45] Feb. 5, 1980

[54] PNEUMATIC MASSAGE MACHINE

[75] Inventor: Tadahisa Mogaki, Tokyo, Japan

[73] Assignee: Man Design Co., Ltd., Tokyo, Japan

[21] Appl. No.: 913,318

[22] Filed: Jun. 7, 1978

[30] Foreign Application Priority Data

Aug. 19, 1977 [JP] Japan ..... 52-109990

[51] Int. Cl.[2] ..... A61H 1/00; A61H 9/00

[52] U.S. Cl. ..... 128/32; 128/65; 128/37

[58] Field of Search ..... 128/37, 65, 66, 47, 128/50, 56, 44, 49

[56] References Cited

U.S. PATENT DOCUMENTS

| | | | |
|---|---|---|---|
| 1,082,285 | 12/1913 | Peterson | 128/37 |
| 1,247,484 | 11/1917 | Albrecht | 128/65 |
| 1,267,833 | 5/1918 | Wilson | 128/65 |
| 1,948,167 | 2/1934 | Cornwell | 128/66 |
| 3,507,599 | 4/1970 | Meszaros et al. | 128/37 |
| 3,910,265 | 10/1975 | Coleman | 128/66 |
| 3,968,789 | 7/1976 | Simoncini | 128/49 |
| 4,007,735 | 2/1977 | Magnusson | 128/37 |

FOREIGN PATENT DOCUMENTS

| | | | |
|---|---|---|---|
| 1115290 | 12/1955 | France | 128/65 |

*Primary Examiner*—Lawrence W. Trapp

*Attorney, Agent, or Firm*—Ostrolenk, Faber, Gerb & Soffen

[57] ABSTRACT

A massage machine has a massage head pneumatically driven for high frequency vibration and a liquid reservoir from which liquid, e.g. hair liquid, is forcibly discharged by simple finger action for dispersion through the massage head nose concurrently with the massage action. Uncomfortable noise trouble caused by air discharge is minimized by forcing the drive air to undergo repeated volume changes during the discharge thereof through the machine.

17 Claims, 6 Drawing Figures

PNEUMATIC MASSAGE MACHINE

BACKGROUND OF THE INVENTION

The present invention relates to a pneumatic massage machine, and more particularly relates to a bi-functional massage machine which is pneumatically driven for high frequency vibration and capable of dispersing liquids, e.g. hair liquid, concurrently with the massage action upon application of simple finger action.

When massage is carried out, it is general to use a suitable liquid or liquids to be dispersed on the portion of the human body to be massaged in order to enhance the massage effect. For example, in the case of hair massage, hair liquid is dispersed on the hair. This dispersion of the liquid may be carried out either concurrently with massage action or separately from the massage action. In order to follow the former manner, one needs to use both hands, one operating the massage machine and the other operating the liquid container. In order to follow the latter manner, the action needs two steps.

In general, a massage machine is provided with a massage head to be brought into pressure contact with portions of human body requiring massage action and a drive mechanism for causing high frequency vibration of the massage head. The drive mechanisms are roughly classified into two types, one being of an electric type and the other being of a pneumatic type. The present invention concerns the massage machine of the latter type.

Aside from professional masseurs, when massage, is carried out at individual homes, it will be more convenient if dispersion of the liquid can be carried out quite concurrently with the massage action without requiring troublesome hand operation.

In addition, when a pneumatically driven massage machine is used, one cannot escape from facing noise trouble inevitably caused by discharge of the drive air. Especially when the massage machine is used at individual homes, generation of irritating intermittent noises is unwelcome since it seriously damages a relaxed home atmosphere.

SUMMARY OF THE INVENTION

It is the principal object of the present invention to provide a novel massage machine capable of carrying out dispersion of liquids such as hair liquid concurrently with the massage action while requiring very simple finger action only.

It is the other object of the present invention to provide a novel massage machine which is almost free from the noise trouble to be caused by discharge of the compressed air used for drive of the vibratory massage head.

In accordance with the basic aspect of the present invention, the massage machine is provided with, in addition to a vibratory massage head, a liquid reservoir and, upon application of finger action, the liquid is forcibly discharged therefrom for dispersion through the massage head nose concurrently with the massage action. A double check valve system is employed in order to enable the above-described forced discharge of the liquid.

In accordance with the developed aspect of the present invention, the internal passage for discharge of the drive air is accompanied by repeated change in the effective cross sectional area in order to cause corresponding change in the volume of the air being discharged.

In the following description, machine parts located on the side of the massage head will be referred to with the expression "front" whereas those located remote from the massage head will be referred to with the expression "rear".

DESCRIPTION OF THE PREFERRED EMBODIMENT

Figure 1:
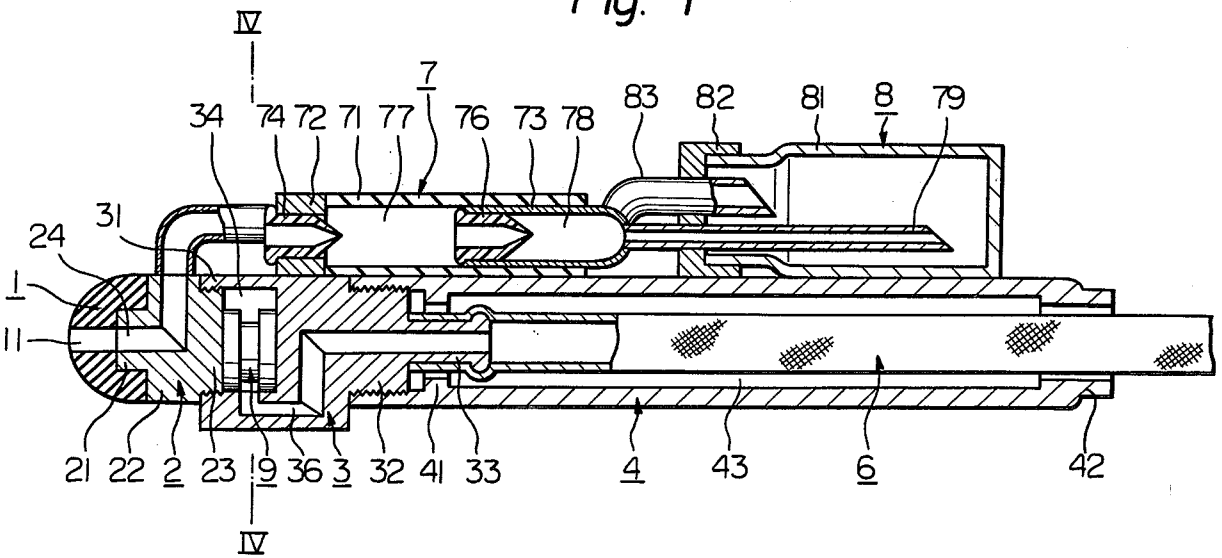
FIG. 1 is a side view, partly in section, of an embodiment of the pneumatic massage machine in accordance with the present invention.
Figure 2:
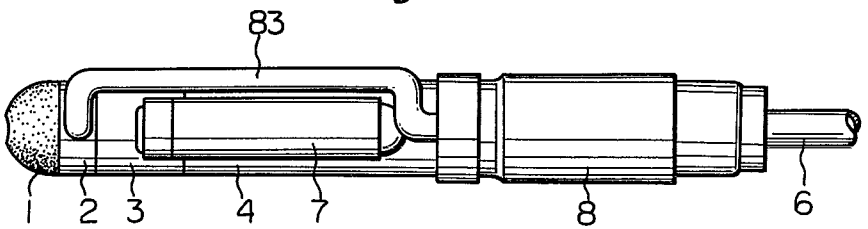
FIG. 2 is a top view of the pneumatic massage machine shown in FIG. 1.
Figure 3:
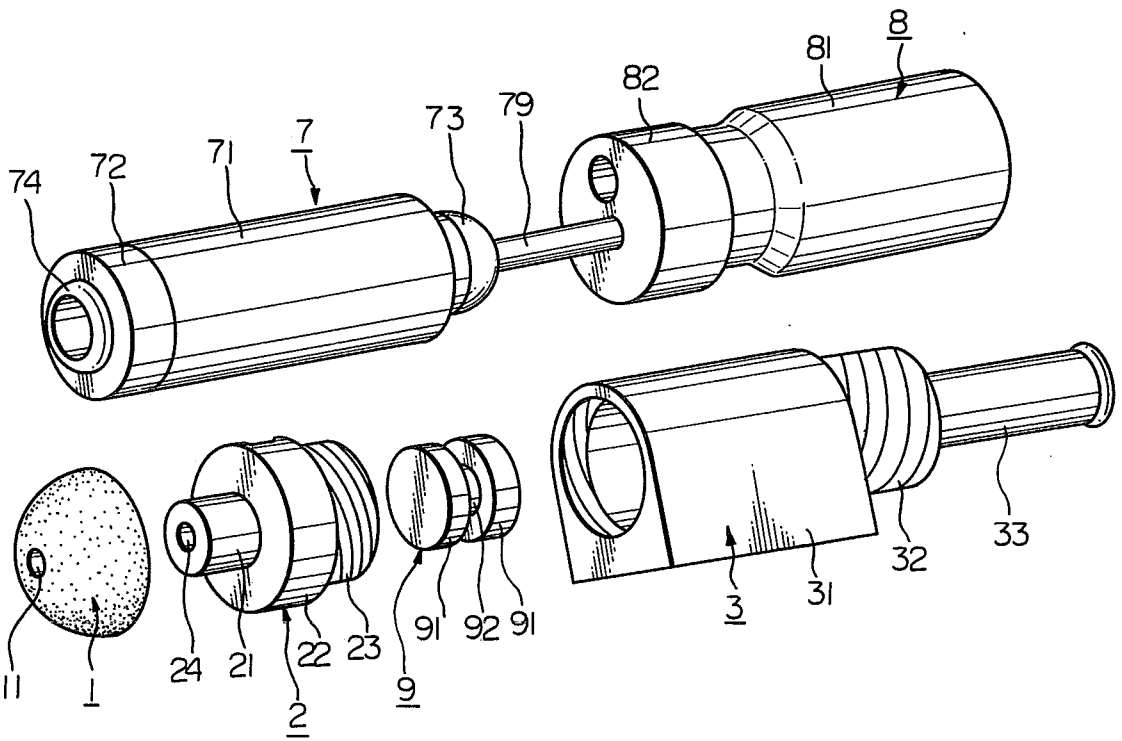
FIG. 3 is a perspective view of several major components constituting the pneumatic massage machine shown in FIG. 1, in a disassembled state.

One embodiment of the pneumatic massage machine in accordance with the present invention is shown in FIGS. 1 through 3, in which the pneumatic massage machine includes, as major components, a semi-spherical massage head 1 made of an elastic material such as rubber, a front cover 2 carrying the massage head, a main body 3 to which the front cover 2 is mounted, a main cylindrical body 4 coupled to the rear side of the main body 3 and an air conduit hose pipe 6 coupled to the rear end of the main body 3 and extending through the main cylindrical body 4 in order to be connected to a suitable supply source of compressed air (not shown) such as a compressor. The above-described components are assembled together substantially in axial alignment to each other. The liquid massage machine further includes an elastically deformable liquid discharger 7 mounted on the main cylindrical body 4 and a liquid reservoir 8 mounted on the main cylindrical body 4 and in operational communication with the liquid discharger 7 as hereinafter described in more detail.

The front cover 2 is provided with a front extension 21 over which the massage head 1 is securedly fitted, a flange 22 and a threaded rear extension 23. A liquid condiut 24 is formed in the front cover 2 which opens at one end in the front end of the front extension and at the other end in the peripheral surface of the flange 22.

The massage head 1 is provided with an axially formed through hole 11 for dispersion of the liquid which is in direct communication with the liquid conduit 24 of the front cover 2.

Figure 4:
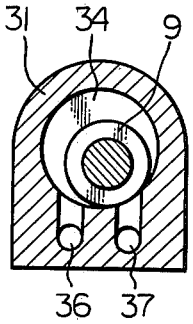
FIG. 4 is a section, partly omitted, taken along the line IV—IV in FIG. 1.

The main body 3 is comprised of an internally hollow front portion 31, an intermediate portion 32 and a rear portion 33. The front portion 31 is in screw engagement with the rear extension 23 of the front cover 2 at the front end portion thereof in order to internally define an operation chamber 34 of a round cross section in which a rotor 9 is encased in a freely axially rotatable and revolvable disposition. The rear portion 33 is adapted for air-tight coupling with the hose pipe 6. An air conduit 36 is formed in the main body 3 which opens at one end in the operation chamber 34 and at the other end in the rear end of the rear portion 33. In addition to this, an air vent 37 is formed in the main body 3 as shown in FIG. 4 which opens at one end in the operation chamber 34 and at the other end in the rear end of the intermediate portion 32.

The main cylindrical body 4 spacially encases the hose pipe 6 and, at the front end portion thereof, is in screw engagement with the intermediate portion 32 of the main body 3. At a position somewhat spaced from the rear end of the intermediate portion of the main body 3, the main cylindrical body 4 is provided with a front bulkhead 41 which spacially surrounds the front end portion of the hose pipe 6 inserted over the rear portion of the main body 3. At the rear end portion, the main cylindrical body 4 is provided with a rear bulkhead 42 which spacially surrounds the hose pipe 6. Thus, a cylindrical chamber 43 is formed between the two bulkheads 41 and 42 while surrounding the hose pipe 6. It will be well understood that the cylindrical chamber 43 is in communication with, on one hand, the operation chamber 34 in the main body 3 via the air vent 37 (see FIG. 4) and annular gap given by the front bulkhead 41 and, on the other hand, the atmosphere via the annular gap given by the rear bulkhead 42.

The rotor 9 is made of a pair of larger diametral flanges 91 and a small diametral interconnecting portion 92. As shown in FIG. 4, the diameter of the flanges 91 of the rotor 9 is smaller than that of the operation chamber 34.

The liquid reservoir 8 includes a cylindrical liquid tank 81 and a front closure 82 and the interior of the tank 81 is connected to the liquid conduit 24 of the front cover 2 via a liquid pipe 83 which extends through the front closure 82.

The liquid discharger 7 includes a cylindrical body 71 made an elastically deformable material such as rubber, a front closure 72 closing the front open end of the cylindrical body 71 and a cylindrical rear closure 73 closing the rear open end of the cyrindrical body 71. The first check valve 74 is disposed to the front closure 72 and the second check valve 76 is disposed to the front end of the rear closure 73. Thus, the first air reservoir 77 is formed between the two check valves 74 and 76 and the second air reservoir 78 is formed in the rear closure 73 which is connected to the interior of the liquid tank 81 of the liquid reservoir 8 via an air pipe 79 extending through the front closure 82 of the liquid reservoir 8. The first check valve 74 allows introduction of the atmospheric air into the first air reservoir 77 only whereas the second check valve 76 allows introduction of the air in the first air reservoir 77 into the second air reservoir 78 only.

In the construction of the main body 3, the air conduit 36 opens in the operation chamber 34 preferably as an axial position corresponding to the interconnecting portion 92 of the rotor 9 encased therein in order that the compressed air ejected therefrom should apply effective drive to the rotor 9. It is further preferable that the front closure 82 of the liquid reservoir 8 is in easily detachable but air- and liquid-tight coupling with the pipes 79 and 83. For this purpose, it is recommended to made the front closure 82 of an elastically deformable material such as rubber and make the diameters of holes receptive of these pipes somewhat smaller than those of the associated pipes. Thus, by pushing the liquid reservoir 8 towards the liquid discharger 7, the above-described coupling can be easily established.

In massage operation, the liquid massage machine of the above-described construction is used as follows. Liquid to be used, e.g. hair liquid, is filled in the liquid reservoir 8 which is thereafter coupled to the pipes 79 and 83 as hereinbefore explained. Next, the free end of the hose pipe 6 is connected to a given supply source of the compressed air and the latter is switched on. The compressed air is then introduced into the operation chamber 34 via the hose pipe 6 and the air conduit 36 of the main body 3, thereby the rotor 9 being driven for furious rotation and revolution within the operation chamber 34. Such rotation and revolution of the rotor 9 within the main body 3 naturally causes high frequency vibration of the massage head 1 coupled to the main body 3 via the front cover 2 and the vibrating massage head 1 is brought into contact with the portion of the human body which is to be massaged, e.g. the head.

Concurrently with the foregoing procedure, the elastically deformable cylindrical body 71 of the liquid discharger 7 is pressed by hand in order to cause deformation of same. As a result of this deformation, the air in the first air reservoir 77 is compressed to open the second check valve 76 and the compressed air flows into the tank 81 of the liquid reservoir 8 via the second air reservoir 78 and the air pipe 79, thereby discharging the liquid into the liquid pipe 83. Thus, the liquid is dispersed out of the vibrating massage head 1 via the liquid conduit 24 and the through hole 11.

As the pressure by hand is removed, the cylindrical body 71 automatically resumes its initial shape due to its nature and the pressure in the first air reservoir 77 becomes negative. The second check valve 76 then automatically closes since the pressure in the second air reservoir 78 is higher that that in the first air reservoir 77. Concurrently with this, the first check valve 74 opens due to the negative pressure in the first air reservoir 77 and the atmospheric air is introduced into the first air reservoir 77 for the sake of the next discharge of the liquid in the liquid reservoir 8.

The air used for drive of the rotor 9 is discharged from the operation chamber 34 through the air vent 37 shown in FIG. 4. During this discharge, the air flows into the cylindrical chamber 43 through the extremely narrow annular gap given by the front bulkhead 41 of the main cylindrical body 4 and further flows out into the atmosphere through the extremely narrow annular gap given by the rear bulkhead 42 of the main cylindrical body 4. In other words, the discharged air undergoes two times of compression when passing through the bulkhead gaps and one time of expansion when spouting into the cylindrical chamber 43. Such repetition of volume change effectively damps noises to be generated by discharge of air into the atmosphere.

Figure 5:
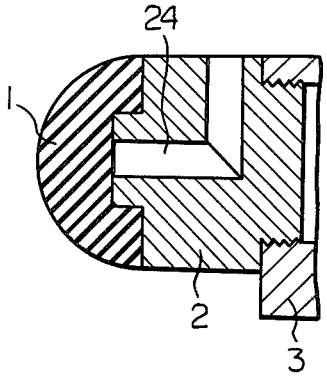
FIG. 5 is a side sectional view of the massage head and its related parts in a variant of the pneumatic massage machine shown in FIG. 1.

A variant of the liquid massage machine shown in FIG. 1 is illustrated in FIG. 5, in which the massage head 1 blocks the through hole 11 but is made of an elastic and finely porous material. Thus, the liquid arriving at the terminal of the liquid conduit 24 of the front cover 2 permeates into the finely porous configuration of the massage head 1 to ooze out on the outer surface thereof for dispersion.

Figure 6:
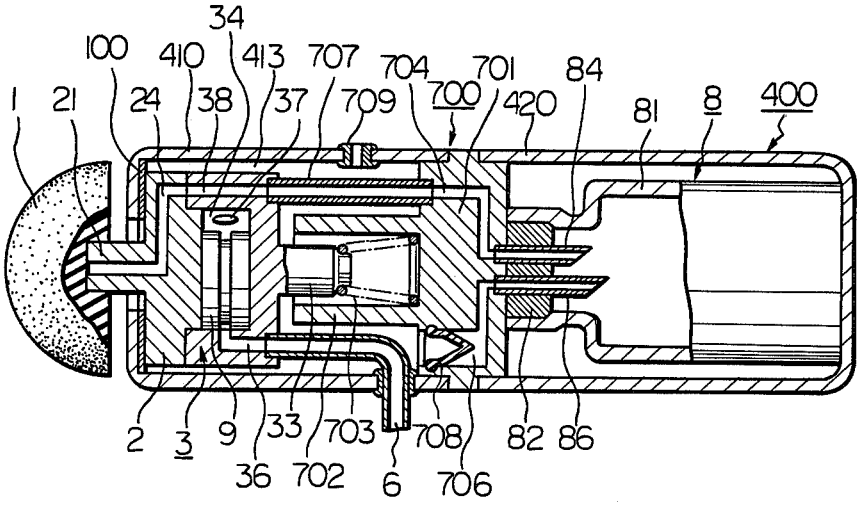
FIG. 6 is a side view, partly in section, of another embodiment of the pneumatic massage machine in accordance with the present invention.

A modified embodiment of the liquid massage machine in accordance with the present invention is shown in FIG. 6, in which the elements located outside the main part, i.e. the cylindrical body 4, of the machine in the construction of the foregoing embodiments are all contained within the main part of the machine, thereby greatly simplifying the outer shape of the machine for easier handling and design effect.

In the following description, mechanical elements substantially similar in construction and function to those used in the foregoing embodiment are designated by similar reference numerals.

Like the foregoing embodiment, the liquid massage machine of this embodiment includes a semi-spherical massage head 1, made of an elastic material such as rubber, a front cover 2 carrying the massage head 1 in front thereof, a main body 3 to which the front cover 2 is mounted, a main cylindrical body 400 comprising a front cylindrical body 410 and a rear cylindrical body 420 closed at the rear end thereof, an air conduit hose pipe 6 coupled to the rear side of the front main body 300, a liquid discharger 700 interposed between the front and rear cylindrical bodies 410 and 420, a liquid reservoir 8 encased within the rear cylindrical body 420 and a rotor 9 disposed within an operation chamber 34 formed in the main body 3.

Like the one shown in FIG. 5, the massage head 1 used in this embodiment is provided with a finely porous configuration for oozing out of the liquid. However, like the one shown in FIG. 1, the massage head 1 may be provided with an axial through hole for dispersion of the liquid.

The front cover 2 is basically similar in the construction thereof to the one used in the embodiment shown in FIG. 1. The only exception is that the front extension 21 extends idly outside the front cylindrical body 410 through the front center hole of the latter and the liquid conduit 24 rearwardly opens in the rear face of the front cover 2.

An annular slide disc 100 made of a low frictional resistant material such as Teflon produced by Du Pont is fixed to the inside surface of the front wall of the front cylindrical body 410 in contact with the front face of the front cover 2 for smooth vibratory movement of the front cover 2 to be caused by revolution of the rotor 9 in the operation chamber 34.

The main body 3 defines the operation chamber 34 which is provided with an air vent 37 opening in the cylindrical chamber 413 defined by the front cylindrical body 410. The main body 3 is further provided with a liquid conduit 38 which runs parallel to the axial direction of the machine forwardly in communication with the liquid conduit 24 of the front cover 2. An air conduit 36 is formed in the main body 3 downstreamly opening in the operation chamber 34 and upstreamly in communication with the hose pipe 6. The opening mode of the air conduit 36 in the operation chamber 34 in relation to the rotor 9 is quite the same with that employed in the embodiment shown in FIG. 1.

The liquid discharger 700 includes a flange 701 and a front extension 702, the flange 701 forming the main support for other elements of the machine. That is, the front and rear cylindrical bodies 410 and 420 are detachably coupled to the flange 701 of the liquid discharger 700.

The front extension 702 is of a hollow cylindrical construction into which the rear portion 33 of the main body 3 idly extends. A compression spring 703 is interposed between the rear portion 33 and the front face of the flange 701 so that the front cover 2, via the main body 3, is suspensorily pressed against the inside surface of the front wall of the front cylindrical body 410. Thanks to this spring support, the front cover 2 and the main body 3 are allowed to undergo fine, high frequency vibratory movement while basically retaining their positions immovably within the machine.

At a position outward from the front extension 702, the flange 701 is provided with a liquid conduit 704 and an air conduit 706, both opening in the front and rear faces of the flange 701. The front opening of the liquid conduit 704 is connected to the liquid conduit 38 of the main body 3 via a pipe 707 extending axially through the cylindrical chamber 413. A check valve 708 is disposed to the front opening of the air conduit 706 in order to allow passage of air from the cylindrical chamber 413 into the air conduit only. An annular piece 709 is disposed in the periphery of the front cylindrical body 410, through which the cylindrical chamber 413 communicates with the atmosphere for the later described purpose.

The liquid reservoir 8 includes the cylindrical liquid tank 81 and the front closure 82 and the interior of the liquid tank 81 is connected, on one hand, to the liquid conduit 704 in the liquid discharger 700 via a pipe 84 and, on the other hand, to the air conduit 706 in the liquid discharger 700 via a pipe 86, both pipes 84 and 86 extending axially through the front closure 82.

In advance of the massage operation, all parts except for the rear cylindrical body 420 and the liquid reservoir 8 are assembled together. After filling the tank 81 with necessary liquid, the liquid reservoir 8 and the rear cylindrical body 420 are both coupled to the liquid discharger 7.

Like the foregoing embodiment, high frequency vibration of the massage head 1 starts upon switching on of the supply source of the compressed air. The compressed air causing the furious rotation and revolution of the rotor 9 escapes out of the operation chamber 34 into the cylindrical chamber 413 through the air vent 37 formed in the main body 3. The compressed air thus filling the cylindrical chamber is then discharged into the atmosphere through the hole of the annular piece 709.

For dispersion of the liquid, the hole of the annular piece 709 is closed by a finger of the user's hand holding the massage machine. This naturally raises the pneumatic pressure within the cylindrical chamber 413 since the air is continuously driven out of the operation chamber 34 and discharge of it into the atmosphere is now hindered. This increased pneumatic pressure automatically and forcibly opens the check valve 708 and the compressed air prevailing in the cylindrical chamber 413 surges into the liquid tank 81 via the air conduit 706 and the pipe 86 in order to discharge the liquid in the tank 81 into the liquid conduit 704 in the liquid discharger 700 via the pipe 84. Thus, the liquid is dispersed out of the vibratory massage head 1 via the pipe 707 and the liquid conduits 38 and 24.

As the finger closure on the annular piece 709 is removed, the compressed air in the cylindrical chamber 413 is again allowed to escape into the atmosphere, the pneumatic pressure in the cylindrical chamber 413 resume the normal value, the check valve 708 closes and the discharge of the liquid from the liquid reservoir 8 ends automatically.

In the case of this embodiment, all the functional components are encased within the main cylindrical body 400 in order to enable easy handling of the massage machine by hand and to provide better design effect. In addition, hand operation necessary for dispersion of the liquid is more simplified than that in the foregoing embodiment.

When the machine is used for portions of the human body other than the head, a suitable massage liquid may be used instead of the hair liquid.

In accordance with the present invention, dispersion of the massage liquid or hair liquid can be carried out quite concurrently with massage operation itself by a simple finger action only. In addition, noise trouble to be otherwise caused by discharge of the compressed air can be excellently minimized.

I claim:

1. A pneumatic massage machine comprising
a semi-spherical vibratory massage head having a construction allowable of dispersion of liquid therethrough,
means for pneumatically driving said massage head for vibration and connected to a given supply source of compressed air,
a main cylindrical body carrying said massage head via said pneumatic driving means,
a liquid reservoir disposed to said main cylindrical body and connected to said massage head for supply of said liquid,
means for forcibly discharging said liquid out of said liquid reservoir upon application of user's finger action thereto and operationally coupled to said liquid reservoir.

2. A pneumatic massage head as claimed in claim 1 in which said massage head is made of an elastic material.

3. A pneumatic massage head as claimed in claim 1 in which said massage head is provided with an axial nose hole for dispersion of said liquid.

4. A pneumatic massage machine as claimed in claim 1 in which said massage head is provided with a finely porous construction allowable of passage of said liquid therethrough.

5. A pneumatic massage machine as claimed in claim 1 in which said liquid reservoir and said discharging means are mounted outside said main cylindrical body.

6. A pneumatic massage machine as claimed in claim 5 in which said pneumatic driving means includes
a main body coupled to the front end of said main cylindrical body, internally defining an operation chamber and having an air conduit opening at one end in said operation chamber and an air vent opening at one end in said operation chamber and at the other end in the interior of said main cylindrical body,
a rotor accommodated within said operation chamber in a freely rotatable and revolvable disposition,
a front cover coupled to the front side of said main body, carrying said massage head, and having a liquid conduit opening in the front face thereof in order to allow introduction of said liquid into said massage head for dispersion, and
a hose pipe connected at one end to the other end of said air conduit formed in said main body and at the other end to said given supply source of compressed air.

7. A pneumatic massage machine as claimed in claim 6 further comprising
means for damping noises to be generated by the air discharged from said operation chamber.

8. A pneumatic massage machine as claimed in claim 7 in which said damping means includes
at least one bulkhead formed within said main cylindrical body while leaving an annular gap around said hose pipe, the outer diameter of said annular gap being smaller than the inner diameter of said main cylindrical body.

9. A pneumatic massage machine as claimed in claim 8 in which a pair of bulkheads are arranged being spaced from each other in the axial direction of said main cylindrical body.

10. A pneumatic massage machine as claimed in claim 6 in which the interior of said liquid reservoir is connected to said liquid conduit of said front cover via a liquid pipe.

11. A pneumatic massage machine as claimed in claim 5 in which said discharging means includes
an elastically deformable cylindrical body mounted outside said main cylindrical body in an arrangement suited for finger pressing,
a first check valve disposed to the front end of said deformable cylindrical body and adapted for introduction of atmospheric air into a first air reservoir formed in said deformable cylindrical body,
a second check valve disposed to a rear closure of said deformable cylindrical body and adapted for introduction of air in said first air reservoir into a second air reservoir formed in said rear closure, and
an air pipe connecting said second air reservoir to the interior of said liquid reservoir.

12. A pneumatic massage machine as claimed in claim 1 in which said liquid reservoir and said discharging means are accommodated within said main cylindrical body.

13. A pneumatic massage machine as claimed in claim 12 in which said pneumatic driving means includes
a main body suspensorily encased within said main cylindrical body, internally defining an operation chamber, and having an air conduit opening at one end in said operation chamber and an air vent opening at one end in said operation chamber and at the other end in the interior of said main cylindrical body,
a rotor accommodated within said operation chamber in a freely rotatable and revolvable disposition,
a front cover coupled to the front side of said main body, carrying said massage head outside said main cylindrical body, and having a liquid conduit opening in the front face thereof in order to allow introduction of said liquid into said massage head for dispersion,
means for placing said front cover in resilient pressure contact with the front wall of said main cylindrical body, and
a hose pipe connected at one end to the other end of said air conduit formed in said main body and at the other end to said given supply source of compressed air.

14. A pneumatic massage machine as claimed in claim 13 in which said placing means includes a compression spring interposed between said main body and said discharging means.

15. A pneumatic pressure machine as claimed in claim 13 in which a slide disc is inserted between said front cover and said front wall of said main cylindrical body.

16. A pneumatic massage machine as claimed in claim 12 in which said discharging means includes
a flange intervening between front and rear halves of said main cylindrical body, and having a liquid conduit and an air conduit both opening in the front face thereof and a check valve disposed to the front end of said air conduit, said front half of said main cylinder defining a cylindrical chamber for accommodating said pneumatic driving means, said rear half of said main cylindrical body accommodating said liquid reservoir, and said check valve allowing introduction of air from said cylindrical chamber into said air conduit, and an annular piece disposed to the periphery of said front half of said main cylindrical body for communication of said cylindrical chamber to the atmosphere.

17. A pneumatic massage machine as claimed in claim 16 in which said liquid conduit formed in said flange is connected at one end to said massage head and at the other end to the interior of said liquid reservoir, and said air conduit formed in said flange is connected to the interior of said liquid reservoir.

* * * * *